United States Patent [19]

Kang

[11] Patent Number: 4,898,849

[45] Date of Patent: Feb. 6, 1990

[54] COATED THERMALLY PRINTABLE MATERIAL AND METHOD OF PRODUCING THE SAME

[75] Inventor: Ming-Huang J. Kang, Nashua, N.H.

[73] Assignee: Nashua Corporation, Nashua, N.H.

[21] Appl. No.: 139,186

[22] Filed: Dec. 29, 1987

[51] Int. Cl.[4] ..... B41M 5/18

[52] U.S. Cl. ..... 503/214; 427/152; 428/40; 428/913; 428/914; 503/200; 503/207; 503/226

[58] Field of Search ..... 427/150–152; 428/913, 914, 40, 327, 330, 421, 422; 503/200, 226, 207, 214, 226

[56] References Cited

U.S. PATENT DOCUMENTS

| | | | |
|---|---|---|---|
| 3,850,672 | 11/1974 | Tani et al. | 117/76 R |
| 4,363,664 | 12/1982 | Delaney | 106/21 |
| 4,370,370 | 1/1983 | Iwata et al. | 428/40 |
| 4,388,362 | 6/1983 | Iwata et al. | 428/211 |
| 4,591,887 | 5/1986 | Arbree et al. | 346/200 |
| 4,593,298 | 6/1986 | Ikeda et al. | 503/226 |
| 4,721,700 | 1/1988 | Hosoi et al. | 503/226 |
| 4,727,054 | 2/1988 | Yuyama et al. | 503/200 |
| 4,740,495 | 4/1988 | Marinelli et al. | 503/226 |

FOREIGN PATENT DOCUMENTS

| | | | |
|---|---|---|---|
| 56-126193 | 10/1981 | Japan | 503/226 |
| 0107884 | 7/1982 | Japan | 503/226 |

OTHER PUBLICATIONS

Japanese Patent Application No. 58 043,450, (abstract obtained from the DIALOG database system), 3–14–83.

Japanese Patent Application No. 60 094,390, (abstract obtained from the DIALOG database system), 05–2–7–85.

Japanese Patent Application No. 60 129,295, (abstract obtained from the DIALOG database system), 07–1–0–85.

Japanese Patent Application No. 82 019,035, (abstract obtained from the DIALOG database sstem), 04–20–82.

*Primary Examiner*—Bruce H. Hess

*Attorney, Agent, or Firm*—Lahive & Cockfield

[57] ABSTRACT

Disclosed is a heat-sensitive recording material useful in the manufacture of thermal paper and thermal labels. The material comprises a cellulosic or other suitable substrate, a thermally imprintable color-producing layer, and a protective layer over the color-producing layer. It may also include a second protective layer and/or a pressure-sensitive adhesive layer, on the surface of the substrate opposite from the color-producing layer, and a releasable liner covering the adhesive layer. The color-producing layer includes a basic, acid-neutralizing agent for both reducing background discoloration during manufacturing and increasing image definition. The protective layer comprises a cross-linked binder and fluorochemical surfactant-treated hydrocarbon or fluorocarbon particles as a friction reducing material.

11 Claims, 1 Drawing Sheet

COATED THERMALLY PRINTABLE MATERIAL AND METHOD OF PRODUCING THE SAME

BACKGROUND OF THE INVENTION

This invention relates to a heat-sensitive recording material. More particularly, the invention relates to a heat-sensitive material including a solvent resistant and friction reducing protective layer useful in the manufacture of adhesive-backed heat-sensitive labels and other thermally sensitive paper stock used in printers and facsimile equipment. The labels are useful in packaging goods which, in transit, storage, or display, may be exposed to diverse solvents, and may be used on meat, produce, or articles of manufacture commonly exposed to water or oleophilic materials. A bar code and/or alphanumeric information may be formed on such labels at the point of sale by imaging the label with a thermal print head.

Known recording materials have a thermally imageable layer comprising a binder, a colorless or pale leuco dye, and an acidic substance that causes the dye to change color on the application of heat. Labels made from such materials are commonly used in grocery stores, delicatessens, and other points of retail sale of commodities sold by weight. Increasingly, they are also used on many other products. At or prior to a sale, the retailer weighs the product, commonly on a machine which integrates a scale, register, and thermal print head, and actuates the machine to deliver a thermally imprinted label indicating the price, weight, and other information in coded and/or alphanumeric form. The label is then affixed to the product, typically by means of a pressure-sensitive adhesive backing layer.

Labels of this type are often exposed to water, fats, oils, and other solvents which can have an adverse effect on the thermal image, increase background discoloration, and in some cases, destroy the machine readability of the imprinted bar codes. The labels are often supplied in strips which may be serially printed rapidly. As printing speed increases, the labels have been observed to jam about the printhead, requiring shutdown, cleanout, and restart.

The risk of exposure to deleterious solvents is much lower in paper intended for use in thermal printers and facsimile devices, but image stability and thermal head-paper frictional effects are nevertheless important in such products.

The use of protective coatings on thermally sensitive materials to protect the thermal image from the deleterious effects of solvents is known. U.S. Pat. No. 4,388,362 to Iwata et al. teaches the application of a water-soluble, resinous protective coat over the heat-sensitive layer. See also U.S. Pat. No. 4,370,370. U.S. Pat. No. 4,591,887 to Arbree et al. teaches the deposition of a resinous protective layer which is covalently cross-linked by melamine formaldehyde in situ to impart very significantly improved solvent resistance. However, all of these protective layers are subject, in varying degrees, to penetration by solvents because of the character of the materials from which they are made.

Previous attempts also have been made to decrease the friction between the printhead and recording material through the use of chemical additives and polymer films. Japanese patent application No. 60-129295-A is understood to disclose a heat transfer material comprising a polyethylene derivative polymer and a silicon or fluorine based surfactant or lubricant. Japanese patent application No. 60-094390-A is understood to disclose a backing layer including a fluorinated surfactant designed to inhibit sticking of the printing material to the printhead. Japanese patent application No. 60040293-A is understood to disclose a heat transfer material including a film containing a lubricant such as a fluorine-containing compound which prevents thermal head sticking.

The chemical engineering involved in designing a barrier layer which not only protects the imaged underlayer from damage from commonly encountered solvents but also overcomes friction at the printhead and consequent jamming can be particularly difficult. It is accordingly an object of this invention to provide heat-sensitive recording material whose thermal image is protected from discoloration, and which is characterized by significantly lower friction between the printhead and recording material.

SUMMARY OF THE INVENTION

In one aspect, the invention features a specialty paper or label stock comprising a heat-sensitive recording material. The material comprises a substrate, a heat-sensitive color-producing layer on a first surface of the substrate, and a protective, cross-linked, friction reducing layer over the color-producing layer. An adhesive layer may be applied on the surface of the substrate opposite the color-producing layer. Preferably, the adhesive is a pressure-sensitive adhesive and is covered with an adhesive, releasable liner.

The color-producing layer may be a now conventional layer, see, e.g., Arbree et al, U.S. Pat. No. 4,591,887, Col. 4, lines 16–60. It comprises a colorless or pale colored leuco dye, preferably in particulate form, an acidic developer substance to cause the dye to undergo color transformation upon image-wise application of heat to the recording material, a polymeric binder material, and an acid neutralizing (basic), preferably particulate, material for reducing background discoloration.

The protective layer of the invention provides a unique combination of lubricating and solvent resistance properties. The protective layer comprises a polymeric material which is covalently cross-linked with the aid of an acid catalyst. Inert filler particles may act as spacer particles in the protective layer. Fluorocarbon surfactant-treated hydrophobic polymer particles composed of a hydrocarbon or fluorocarbon polymer are included in the coating as a lubricant. The use of a fluorocarbon surfactant, in combination with cross-linking in situ, has been discovered to result in a barrier coat that remains impervious to hydrophilic and hydrophobic solvents despite the presence of hydrophobic lubricant particles penetrating the coating.

In preferred embodiments, the color-producing layer has a coating weight of approximately 3.0 to 8.0 grams of solids per square meter (approximately 2 to 5 pounds/ream). Its binder is a water-soluble material such as polyvinyl alcohol. The leuco dye may be a fluoran, phthalide, lactone or triaryl methane dye, or others known to those skilled in the art.

The protective layer preferably has a coating weight of about 3.0 to 8.0 grams of solids per square meter (2.0 to 5.0 pounds/ream). The polymeric binder material preferably comprises a carboxylated polyvinyl alcohol. An acid catalyst, preferably an organic acid catalyst, e.g., fumaric acid, is utilized to covalently cross-link with melamine formaldehyde or another cross-linking agent. In addition to or instead of fumaric acid, malonic acid, tartaric acid, maleic acid, diglycolic acid, and other carboxylic, sulfonic, or mineral acids may be used. The inert filler particles preferably comprises particles of alumina trihydrate ($Al_2O_3.3H_2O$). The friction reducing particles preferably comprises a fluoropolymer or polyethylene coated with a surfactant such as an amine perfluoroalkyl sulfonate. Polytetrafluoroethylene is a preferred fluoropolymer.

The recording material preferably also may have a second protective layer disposed on the side of the substrate opposite the imaging layer, i.e., between the substrate and the adhesive layer, if an adhesive layer is employed.

The recording material of the invention is manufactured by the sequential application of two aqueous dispersions to the substrate, typical paper. The first dispersion, in addition to conventional color-producing components and binder, typically includes an acid-neutralizing agent to protect the dye from a premature reactive exposure resulting from the subsequent application of the acidic protective layer.

The second dispersion acts as a solvent resistant, friction reducing coating. In preferred embodiments, the protective coating is manufactured by blending a water soluble organic resin, which can be cross-linked covalently in situ, with hydrocarbon and/or fluorocarbon polymer particles and a fluorinated surfactant. The organic resin is preferably carboxylated polyvinyl alcohol. The preferred organic cross-linking agent is melamine formaldehyde. The preferred friction reducing particles are polyethylene, most preferably polytetrafluoroethylene. For every 100 parts by weight resin binder present in the dispersion, it contains 1–200, preferably 1–100, more preferably 5–80, and most preferably 15–52 parts by weight crosslinking agent, 0.05–60, preferably 0.05–40, more preferably 1–40, and most preferably 1–9 parts by weight friction reducing particles, and $10^{-6}-20$, preferably $10^{-5}-10$, more preferably $10^{-4}-1$, and most preferably about $10^{-2}$ parts by weight fluorinated surfactant. The inert filler particles are present at a level of about 10–500, preferably 20–400, more preferably 50–240, and most preferably about 100–140 per 100 parts resin binder. The fluorinated surfactant, preferably an amine perfluoroalkyl sulfonate, after application and curing of the coating dispersion, interacts with the polymer particles and other components in the mixture to maintain the integrity of the protective layer against hydrophilic and hydrophobic solvents, despite the presence of the hydrophobic lubricant particles in the aqueous coating solution. Application of this mixture to the precoated substrate is accomplished through the use of a Meyer rod, or other conventional means known to those skilled in the art.

The sequential coating of the substrate thus results in a recording material with improved thermal image stability and solvent resistance. In addition, the lubricating material, contained within the protective layer, acts to decrease friction between the printhead and recording medium, and reduces jamming at high printing speeds.

It is accordingly an object of the invention to provide a heat-sensitive material having a color-forming layer covered by a water-insoluble layer that protects the thermal image from fading and background discoloration caused by exposure to solvents. Another object is to provide a heat-sensitive recording material which may be imprinted with a thermal image that consistently can be read by product code scanning equipment, has a high scanning efficiency, and is characterized by a more uniform image density and minimum background discoloration. Still another object is to provide a thermal paper product including friction reducing particles in the protective coating layer while maintaining the solvent resistant characteristics of the layer.

These and other objects and features of the invention will be apparent from the description and claims which follow, and from the drawing.

DESCRIPTION

Figure 1:
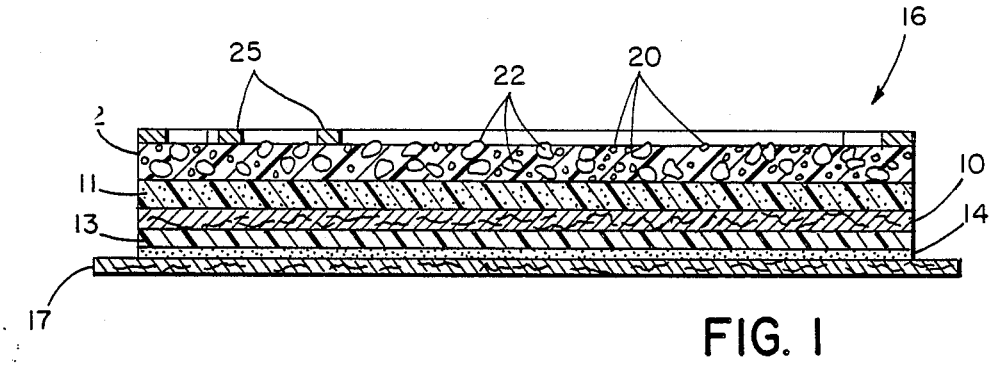
FIG. 1 is a schematic cross-sectional view of a recording label embodying the invention.
Figure 2:
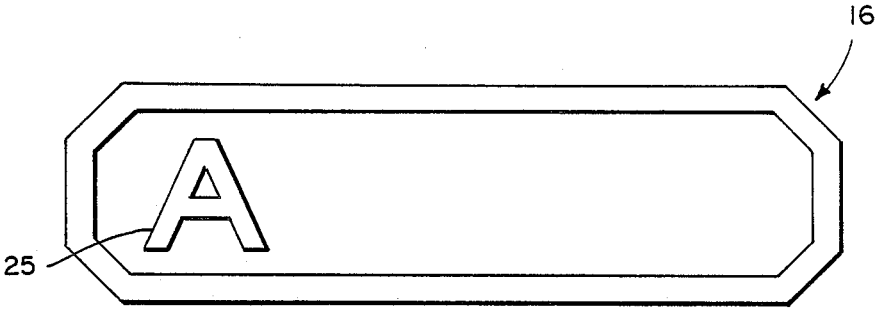
FIG. 2 is a plan view of the front side of the label of FIG. 1.

Referring to the drawings, FIGS. 1 and 2 schematically illustrate a label 16 embodying the invention. It comprises a typically medium weight cellulosic substrate 10. Adhered to the top side of the substrate is a heat-sensitive color-forming layer 11 that preferably has a coating weight of approximately 3 to 8 grams solids per square meter. Sandwiching layers 10 and 11 are a pair of protective layers 12 and 13. Layer 13 is covered by an adhesive layer 14 which in turn is protected until use by adhesive layer 17.

Layer 11 is a thermally sensitive, imagewise exposable layer which can vary widely in composition. It may comprise a composition known in the art. It preferably comprises an intimate mixture of pale colored or colorless leuco dye, an acidic substance which functions to develop the dye, a polymeric binder material, and a particulate neutralizing agent.

The dye of layer 11 may be of the type generally known in the art which is activated by contact with a proton donating (acidic) substance such as a metalized, e.g., zincated, organic acidic material. The preferred dyes are fluoran, lactone, phthalide, or triaryl methane dyes such as crystal violet lactone, 3-N-cyclohexyl, N-methyl-amino 6-methyl-7-anilino fluoran, or 3-pyrrolidino-6-methyl-7-anilino fluoran. Many other leuco dyes known to those skilled in the art may be used. The dye is typically present in particulate form, preferably as particles in the micron size range for adequate resolution as known by those skilled in the art.

The acidic developer substance comprises an organic acidic material, optionally treated with a metal such as zinc. Examples of materials which may be used include bisphenol A, phenolic condensation products, and various low melting point organic acids or their esters. The currently preferred developer material is para-benzyl hydroxybenzoate.

The polymeric binder of layer 11, for processing purposes, is preferably at least partly water-soluble. It comprises one or a mixture of resinous materials which act to hold the other constituents of layer 11 together. The currently preferred binder material is polyvinyl alcohol. Other known binders which may be used include polyvinyl pyrrolidone, polyacrylamide, or modified celluloses.

The neutralizing agent contained in layer 11 may comprise a neutral colored, water-insoluble particulate material. In addition to the foregoing, layer 11 may also include inert fillers, lubricants, dispersants, and defoaming agents present in minor amounts as processing aids.

Adhered to thermally sensitive color-forming layer 11 is a cross-linked protective layer 12. It functions to maintain the contrast and readability of thermal images imprinted in layer 11 despite exposure to oils, fats, water, plasticizing materials and the like which may come in contact with the coated stock. It also functions as a lubricating layer to facilitate transport of the coated substrate over surfaces, and to minimize jamming when strips of labels or continuously fed paper are printed at high speed with a thermal head by imagewise thermal exposure of layer 11. Layer 12 is formed in situ from a previously prepared aqueous coating composition.

The coating comprises a resin which is cross-linked in situ at room temperature or a higher temperature, provided the higher temperature is insufficient to develop prematurely the leuco dye. The protective layer's properties of improved resistance to solvents such as oils and plasticizers is directly traceable to the cross-links formed in situ during manufacture of the product of the invention. Preferably, the resinous components of layer 12 comprise a major amount of binder, e.g., carboxylated polyvinyl alcohol or other resin which can be cross-linked covalently. Examples include water-soluble polymers such as polyvinyl alcohol and various derivatives thereof, polyvinyl pyrrolidones, various copolymers including water-soluble groups including maleic and other anhydrides, and various water-soluble cellulose based materials. Where the preferred carboxylated resins are used, crosslinking is accomplished via the resin's hydroxy groups, with melamine formaldehyde or another glyoxyl-type material, multifunctional aziridines or aldehydes, or other commercially available crosslinker. Other types of water-soluble polymers may be cross-linked with various known cross-linking agents such as aminoplast-type crosslinkers including polyamide epichlorohydrin. Layer 12 also includes lubricating particles 20 to decrease surface friction, and inert filler particles 22 which act as spacer particles (shown in the drawing as irregularly shaped, and circular bodies, respectively, by way of illustration). The lubricating particles 20 preferably comprise hydrocarbon and/or fluorocarbon particles, and must be present in the coating 12 together with a fluorocarbon surfactant in order to achieve the outstanding combination of properties disclosed herein. The particles act to decrease friction between the printhead and the label material 16. Various inert, heat stable polymer particles may be used. The particle size may range from 0.1–50, and preferably 0.5–15 micrometers. Polyethylene and polytetrafluoroethylene particles are preferred. Generally, however, various fluorinated or halogenated copolymer particles may be used including polypropylene and silicone resins having a high enough melting point to maintain their lubricating properties when exposed to a printing head. These and other types of particles are commercially available. The useful range of lubricant particle content is 0.05–60, most preferably 1.0–9 parts by weight per 100 parts binder resin in the coating.

The fluorocarbon surfactants appear to be a unique processing aid which has the ultimate effect of very significantly inhibiting solvents from infiltrating the protective layer at the interface of the particles and the remainder of the coating. Due to the inherent incompatibility of the surface of the lubricating particles and aqueous solution, it is difficult to disperse the particles. The barrier properties of the lubricated films are greatly reduced if dispersants other than the fluorochemical surfactants are employed. This class of surface active agents enables excellent surface wetting in the aqueous composition of the type described to ensure, when the protective coating is effectively cross-linked, the outstanding resistance against penetration of water, oils, and plasticizers.

The preferred fluorochemical surfactants are ammonium, amine, or alkali metal salts of perfluoroalkyl sulfonates and carboxylates. Fluorinated alkyl quartenary ammonium halides, polyoxyethylene ethanols, alcoxylates, and esters may also be used. Generally, the fluoroalkyl moiety in these compounds comprises between 5 and 25 carbon atoms or more. Numerous species of this class of surface active agents are available commercially. Generally, the length and the number of fluorine atoms disposed on the tail are altered to meet specific needs. These fluorocarbon surfactants rather dramatically can reduce surface tension, improve wetting, and, in the context of the invention, assure relative impermeability of the coating and of the lubricating particles in the barrier coating. While cationic, amphoteric, and nonionic fluorinated surfactants may be used, the preferred surfactants are anionic. Amine perfluoroalkyl sulfonates are most preferred.

Materials of the type described immediately above are available from a number of suppliers. One line of surfactants of this type is commercially available from Minnesota Mining and Manufacturing Company under the trademark Fluorad. Surfactants of this type are also available from E. I. DuPont de Nemours under the tradename Zonyl. Useful ranges of the fluorochemical surfactant, per part by weight of other ingredients in the coating, are $10^{-6}$—20 parts per 100 parts binder resin, most preferably about $10^{-2}$ parts.

A preferred filler 22 is alumina trihydrate, ground to a particle size in the range of one micron in diameter. The binder of layer 12 preferably comprises a major amount of carboxylated polyvinyl alcohol cross-linked covalently with a minor amount of melamine formaldehyde. It has been found that cross-linking of the coating is optimized at room temperature (70° F.) when the pH of the resin mixture is within the range of approximately 3.5 to 5.5. At pH levels elevated above approximately 5.5, the covalent cross-linking reaction slows and eventually cease. In order to achieve optimum covalent cross-linking, a sufficient volume of acid is added so as to achieve a pH in the pre-application coating dispersion of no greater than about 3.0. Upon deposition onto the color-forming layer, and exposure to the neutralizing agent therein, the pH of the dispersion rises to the desired range of 3.5 to 5.5, and optimum covalent cross-linking is achieved. A preferred acidic substance for this purpose is a dibasic carboxylic acid such as fumaric acid.

Label 16 also preferably includes a water-insoluble lower protective layer 13, coated on substrate 10, on the side opposite the color-forming layer 11. Layer 13 protects the color-forming layer 11 from contaminants such as oils, water, and plasticizers that may seep through the package to which label 16 is adhered. The lower protective layer 13 may be similar or identical in composition to the protective layer 12, i.e., may comprise a water-insoluble cross-linked resin with or without inert filler particles and friction reducing agents.

A pressure-sensitive or other type of adhesive layer 14 may be deposited on protective layer 13. Adhesive layer 14 is deposited in a conventional manner, and backed by an adhesive releasable liner 17. Adhesive liner 17 may comprise paper coated with silicone or other suitable adhesive material. The label may be printed with a suitable ink with a bar code or alphanumeric character illustrated at 25.

The invention will be further understood from the following non-limiting examples wherein all parts are by weights.

EXAMPLES

The approach to production of the improved thermally sensitive labels, sheets, etc. embodying the invention is to apply the barrier layer directly over a previously applied thermally sensitive layer. To produce the thermal layer, one prepares a first dispersion containing the leuco dye and other ingredients set forth below, a second dispersion comprising the acidic developer material and particulate neutralizing agent, then mixes the dispersions, and applies the product to a substrate.

Examples of dispersion I (Mix A) and dispersion 2 (Mix B) are set forth below.

| Color Forming Layer | Part |
|---|---|
| Mix Dispersion A | |
| Polyvinyl alcohol (approx. 10% solution) | 110 parts |
| 3-N—cyclohexyl, N—methyl amino-6-methyl-7-anilino fluoran | 50 parts |
| Defoamer | 0.1 part |
| Water | 140 parts |
| Mix Dispersion A' | |
| Polyvinyl alcohol (approx. 10% solution) | 100 parts |
| Crystal Violet Lactone | 60 parts |
| Defoamer | 0.1 part |
| Water | 160 parts |
| Mix Disperson A" | |
| Carboxy methyl cellulose (approx. 10% solution) | 110 part |
| 3 Pyrrolidino-6 methyl-7 anilino fluoran | 55 parts |
| Defoamer | 0.1 parts |
| Water | 145 parts |
| Mix Dispersion B | |
| Polyvinyl alcohol (approx. 10% solution) | 100.0 parts |
| Water | 140.0 parts |
| Dispersing agent | 2.0 parts |
| Zinc stearate | 10.0 parts |
| Aluminum trihydrate | 27.5 parts |
| p-Benzyl hydroxybenzoate | 20.0 parts |
| Calcium carbonate | 2.5 parts |
| Mix Dispersion B' | |
| Polyvinyl alcohol (approx. 10% solution) | 100 parts |
| Water | 140 parts |
| Dispersing agent | 2 parts |
| Stearamide (steric acid amide) | 10 parts |
| Talc | 28 parts |
| Bis-phenol A | 20 parts |
| Calcium carbonate (particulate) | 3 parts |

Mix A, A' and A" may be prepared by first dispersing the ingredients in the water using a Baranco mixer for 15 minutes, and then reducing the particle size by way of attrition for 60 minutes.

The B or B' mix may be prepared by dispersing the ingredients using a mixer for 15 minutes after all of the dry components are added together. The ingredients are added to the mix tank in the order shown above. The particle size is reduced by attriting for 30 minutes.

Any one of the "A" mix dispersions may be combined with either of the "B" mix dispersions at a ratio of 5 to 15 parts A per 50 parts B. The blend is then coated onto paper e.g., 39 pound (24×36) and dried to produce a dry coating weight of approximately 6 grams per square meter.

Barrier Coating

The protective coating is prepared by adding to 100 parts of a 5% polyvinyl alcohol solution (e.g., Vinyl 165), 0.4 parts fumaric acid, 1.4 ppm amine perfluoralkyl sulfonate (e.g., Fluorad FC-99, 3M company), and 0.036 part dispersant (e.g., Darvan No. 7, Vanderbilt Co.), 6 parts alumina trihydrate (e.g., Hydral 710, Alcoa) and 0.18 parts polyethylene powder (e.g., polymist A12, Allied Chemical Co.). This mixture is dispersed in a Waring blender for a period of 20 minutes. To the resulting solution is added one part aminoplast resin curing agent (e.g., Cymel 385, melamine formaldehyde) and 0.01 parts of a wetting agent (e.g., Triton X-100). This composition is then applied to a previously coated substrate with a Meyer rod at a surface density of about 4 grams/$m^2$.

The protective layer prepared and applied as disclosed above is tested for its resistance to plasticizers, oils and water, as well as for its friction value. Plasticizer resistance is ascertained by measuring the image density of the imaged label, wrapping the labels in Borden Resinite RMF-61 Y PVC film, heating the wrapped label to 100° F. at 2.5 p.s.i. for 16 hours, and measuring the resulting image density. Oil resistance is determined by measuring the image density, spreading soybean oil on the imaged label surface, heating the treated label to 100° F. for 16 hours, and then remeasuring the image density. Water resistance of the imaged labels is measured by making image density measurements of the imaged label before and after 16 hours of soaking in water at room temperature. Determination of the improvement in the label's friction values is accomplished by a comparison of similarly prepared lubricant and non-lubricant containing labels in an in-house designed friction measurement protocol.

The barrier coat of this example imparts to the thermally sensitive paper a friction value of 0.707 pound. Thermal paper produced and tested identically to the procedure noted above but omitting the polyethylene particles has a friction value of 1.01 pound.

EXAMPLE II

Following the procedure of Example I, a protective coating is prepared by adding to 100 parts of a 5% polyvinyl alcohol solution, 1 part fumaric acid, 2.7 ppm amine perfluoralkyl sulfonate, 0.027 parts dispersant, 4.5 parts alumina trihydrate, and 34 parts particulate polytetrafluoroethylene (SST-3H Shamrock Chem. Corp.). This mixture is dispersed in a Waring blender for 20 minutes. To the resulting solution is added 1 part of melamine formaldehyde cross-linking agent (Cymel 385) and 0.01 parts of a wetting agent. This dispersion is applied to the coated substrate with a Meyer rod at a coating weight of about 4.5g/$m^2$.

The dried, coated product gave a friction value of 0.663 lb. An identical product made from the same composition but omitting the particulate polytetrafluoroethylene had a friction value of 0.963 lb.

EXAMPLE III

Following the procedure of Example I, a protective coating is prepared by adding to 100 parts of a 5% aqueous polyvinyl alcohol solution 1 part fumaric acid, 2.4 ppm amine perfluoralkyl sulfonate, 0.039 parts dispersant, 9 parts alumina trihydrate, 0.27 parts particulate polyethylene, and 0.27 parts particulate polytetrafluoroethylene. This mixture is dispersed in a Waring blender for 20 minutes. To the resulting solution is added 0.82 parts melamine formaldehyde resin and 1 part wetting agent. This dispersion is then deposited on the coated substrate with a Meyer rod at a surface density of 4–5 g/m$^2$.

The paper has a friction value measured at 0.58 lb., compared to 0.68 lb. for paper having a barrier coat omitting the lubricant particles. The papers showed 90% and 91%, respectively, of optical density retention in the oil and plasticizer resistance tests. Paper having a barrier coating formulated identically to the barrier of this example except that the fluorinated sulfonate was omitted had corresponding oil and plasticizer resistance readings of 32% and 21%, respectively.

EXAMPLE IV

Experiments were conducted to assess the effect of the fluorinated surfactant on image density retention in thermal labels using the oil resistance test. Four batches of protective barrier coating compositions having the ingredients set forth below were coated over the same thermally sensitive coating. Each of the labels was imprinted, measured for image density, subjected to oil resistance test described above, and then remeasured for image density. The percent image density loss is noted for each sample.

Effect of Fluorocarbon Surfactant on Image Density Loss Using Oil Resistance Test

| Effect of Fluorocarbon Surfactant on Image Density Loss Using Oil Resistance Test | | | | |
|---|---|---|---|---|
| Composition | A | B | C | D |
| binder resin | 100 | 100 | 100 | 100 |
| cross-linking agent | 52.7 | 52.7 | 52.7 | 15.8 |
| fluorinated surfactant | — | — | — | $7.2 \times 10^{-3}$ |
| lubricating particles | 1.33 | 4.00 | 6.67 | 9.00 |
| alumina trihydrate | 133 | 133 | 133 | 120 |
| Percent loss of Image Density | 55.4 | 68.5 | 80.6 | 7.70 |

As is evident from the data, as lubricating particle content increases, the efficacy of the barrier coating decreases, even in the presence of high levels of cross-linking agent. When a small amount of fluorinated surfactant is added, the barrier properties of the coating improve dramatically.

EXAMPLE V

Using the procedure of Example I, a coating composition was formulated using the following relative parts by weight.

| Ingredient | Parts by weight |
|---|---|
| Polyvinyl alcohol | 100 |
| cross-linking agent | 17.7 |
| nonionic fluorinated surfactant | $1.62 \times 10^{-2}$ |
| polyethylene particles | 2.02 |
| alumina trihydrate | 135 |

This coating composition was coated over a thermally imageable coating, cured at room temperature, and tested for friction value and percent image density loss using the oil resistance test. The results were compared with a control made in accordance with U.S. 4,591,887 and with four composition omitting the fluorinated surfactant. The results are set forth below.

| Composition | Friction Value | % Density loss |
|---|---|---|
| Example V | 0.767 | 4.6 |
| Control | 0.809 | 20.0 |
| Surfactant-free | 0.662–0.704 | 50.4–77.3 |

The invention may be embodied in other specific forms, not delineated in the above examples, without departing from the spirit and scope thereof.

Other embodiments are within the following claims.

What is claimed is:

1. A heat-sensitive recording material comprising:

A. a substrate;

B. a thermal imagewise imprintable color-producing layer affixed to a first surface of said substrate comprising a leuco dye developable upon exposure to an acidic developer, an acidic developer, and a binder material for said dye and developer; and C. a protective layer overlying said color-producing layer, wherein said protective layer comprises;

an organic water soluble resin cross-linked during its formation in situ atop said color-producing layer and containing dispersed friction reducing polymer particles and a fluorocarbon surfactant, said material being characterized by decreased surface friction and resistance to background discoloration and image fading induced by exposure to solvents.

2. The material of claim 1 wherein said protective layer comprises an organic resin film cross-linked during its formation on said substrate by an acid-catalyzed, covalently acting cross-linking agent.

3. The recording material of claim 1 further comprising an adhesive layer affixed to a second surface of said substrate opposite said first surface.

4. The material of claim 1 wherein said color-producing layer comprises particulate calcium carbonate.

5. The material of claim 1 wherein said protective layer comprises a carboxylated polyvinyl alcohol resin, cross-linked covalently with melamine formaldehyde.

6. The material of claim 1 wherein said friction reducing particles comprises heat stable polymeric particles selected from the group consisting of polymeric hydrocarbons and polymeric fluorocarbons.

7. The material of claim 6 wherein said particles are selected from the group consisting of polyethylene particles and polytetrafluoroethylene particles.

8. The material of claim 1 wherein said fluorocarbon surfactant is an amine perfluoroalkyl sulfonate.

9. The material of claim 1 wherein said color-producing layer comprises a fluoran dye, a polyvinyl alcohol binder and calcium carbonate particles, and said protective layer comprises carboxylated polyvinyl alcohol cross-linked with melamine formaldehyde and contains dispersed aluminum trihydrate, an amine perfluoroalkyl sulfonate, and friction reducing particles selected from the group consisting of polyethylene and polytetrafluoroethylene.

10. The material of claim 1 comprising the following ingredients in the following parts by weight:

| Ingredient | Parts by Weight |
|---|---|
| polymeric binder material | 100 |
| organic cross-linking agent | 1 to 200 |
| fluorocarbon surfactant | $10^{-6}$ to 20 |

-continued

| Ingredient | Parts by Weight |
|---|---|
| friction reducing particles | 0.05 to 60 |
| inert filler particles | 10 to 500 |

11. The material of claim 1 comprising the following ingredients in the following parts by weight:

| Ingredient | Parts by Weight |
|---|---|
| polymeric binder material | 100 |
| organic cross-linking agent | 5 to 80 |
| fluorocarbon surfactant | $10^{-4}$ to 2.0 |
| friction reducing particles | 1.0 to 20 |
| inert filler particles | 50 to 240 |

* * * * *